US005435537A

United States Patent [19]

Gysling

[11] Patent Number: 5,435,537

[45] Date of Patent: Jul. 25, 1995

[54] CUT SHEET PICK AND FEED MECHANISM WITH ACTIVE SHEET SEPARATION DEVICE

[75] Inventor: Peter Gysling, Boise, Id.

[73] Assignee: Hewlett-Packard Company, Palo Alto, Calif.

[21] Appl. No.: 259,768

[22] Filed: Jun. 14, 1994

[51] Int. Cl.[6] ..... B65H 5/00

[52] U.S. Cl. ..... 271/10.05; 271/116; 271/118; 271/122; 271/164; 271/167

[58] Field of Search ..... 271/10, 114, 115, 116, 271/117, 118, 122, 162, 164, 167

[56] References Cited

U.S. PATENT DOCUMENTS

| | | | |
|---|---|---|---|
| 5,039,080 | 8/1991 | Kato et al. | 271/122 |
| 5,199,696 | 4/1993 | Kato | 271/10 |
| 5,209,465 | 5/1993 | Sayama et al. | 271/122 X |
| 5,294,106 | 3/1994 | Tukagi et al. | 271/164 |

FOREIGN PATENT DOCUMENTS

| | | | |
|---|---|---|---|
| 0315429 | 12/1988 | Japan | 271/118 |
| 0178125 | 7/1990 | Japan | 271/118 |

*Primary Examiner*—H. Grant Skaggs
*Assistant Examiner*—Carol L. Druzbick

[57] ABSTRACT

A printer includes an opening in communication with a tray receptacle for receiving a paper tray. The printer further includes a pick roller assembly; a separator shaft including a first separator roll; an arm structure connecting the pick roller assembly to the separator shaft and enabling a pick action to be imparted to the pick roller assembly; and a feed roller coupled to the separator shaft. A removable media tray is positioned in the tray receptacle, holds a stack of paper sheets and includes a second separator roll and a gear that couples the second separator roll to the separator shaft. A controller causes (i) a rotation of the separator shaft and separator roll in a first direction to enable a paper pick action and to simultaneously rotate the second separator roll to enable a paper sheet separation action, and (ii) a rotation of the separator shaft in a second direction to disable the pick action and to rotate the feed roll to accomplish a paper feed.

10 Claims, 5 Drawing Sheets

CUT SHEET PICK AND FEED MECHANISM WITH ACTIVE SHEET SEPARATION DEVICE

FIELD OF THE INVENTION

This invention relates to a cut sheet feed mechanism for use with image recording machines and, more particularly, to a cut sheet feed mechanism that accommodates an insertable sheet-holding tray and enables sheet feed in the direction of tray extraction.

BACKGROUND OF THE INVENTION

Many electrostatic copiers and laser printers employ removable sheet-holding trays which, when inserted, enable automatic feeding of sheets from a stack held in a tray. In general, sheets are fed in the direction of insertion of the tray into the printer/copier. The sheet pick and feed mechanism is integral to the printer/copier and engages the stack of sheets when the tray is inserted.

A popular mechanism for paper picking and feeding employs corner separation devices in conjunction with "D" shaped feed rollers. The D rollers attempt to feed a top sheet from a stack but the corners of the sheet are trapped under metal corners separators. As the D rollers rotate and continue to attempt to feed the sheet, the sheet slides and buckles at the corners until it snaps out from under the corner separators and is free to continue travelling into the printer/copier. The rest of the stack is held in position by the corner separators.

The corner separation method is popular as it is relatively simple and inexpensive. It's principal disadvantage is, however, that it is not a reliable method for separating sheets of paper, especially when the properties of the paper vary with humidity, handling, etc. With certain papers, the amount of friction between individual sheets in a stack can vary greatly. In such case, the corner separation mechanism is unable to separate a first sheet from the rest of the stack, and two or more sheets of paper are fed into the printer, potentially causing a jam.

Sheet feed trays that incorporate corner separators also often include springs and plates to push the stack of sheets up and into engagement with a sheet pick mechanism. In addition to being noisy, such springs and plates render it more difficult to load paper into the tray, and, at times, cause the paper to be loaded improperly. Furthermore, such springs and plates are often engaged by solenoids and cams which add cost and complexity to the unit.

U.S. Pat. Nos. 5,199,696 and 5,039,080, both to Kato, illustrate a sheet feeding unit similar to that described above. More particularly, Kato describes a paper feeding unit wherein a stack of sheets are held in a cassette that is insertable into a copier mechanism. Sheet feed is from the rear of the cassette, with the stack of sheets held on a movable plate which raises the stack into engagement with a pick roller. The pick roller is rotatable so as to be either in engagement with or out of engagement with the stack of sheets, depending upon the status of the copier. Counter-rotating rollers are used to enable sheet separation during the feed action.

Accordingly, it is an object of this invention to provide an improved sheet feed mechanism that avoids the use of corner separators to enable sheet separation.

It is another object of this invention to provide an improved sheet feed mechanism which enables sheet feed in a direction of paper tray extraction.

It is yet another object of this invention to provide an improved sheet feed mechanism for cooperation with a stack of sheets in a removable sheet-holding tray, wherein the tray includes no pressure plate or other stack-movement mechanism.

SUMMARY OF THE INVENTION

A printer includes an opening in communication with a tray receptacle for receiving a paper tray. The printer further includes a pick roller assembly; a separator shaft including a first separator roll; an arm structure connecting the pick roller assembly to the separator shaft and enabling a pick action to be imparted to the pick roller assembly; and a feed roller coupled to the separator shaft. A removable media tray is positioned in the tray receptacle, holds a stack of paper sheets and includes a second separator roll and a gear that couples the second separator roll to the separator shaft. A controller causes (i) a rotation of the separator shaft and separator roll in a first direction to enable a paper pick action and to simultaneously rotate the second separator roll to enable a paper sheet separation action, and (ii) a rotation of the separator shaft in a second direction to disable the pick action and to rotate the feed roll to accomplish a paper feed.

DETAILED DESCRIPTION OF THE INVENTION

While the invention to be described below is useable with many types of cut media sheets, it will be described in the context of a paper handling mechanism—as that is the most commonly used cut sheet employed with printers and copiers.

Figure 1:
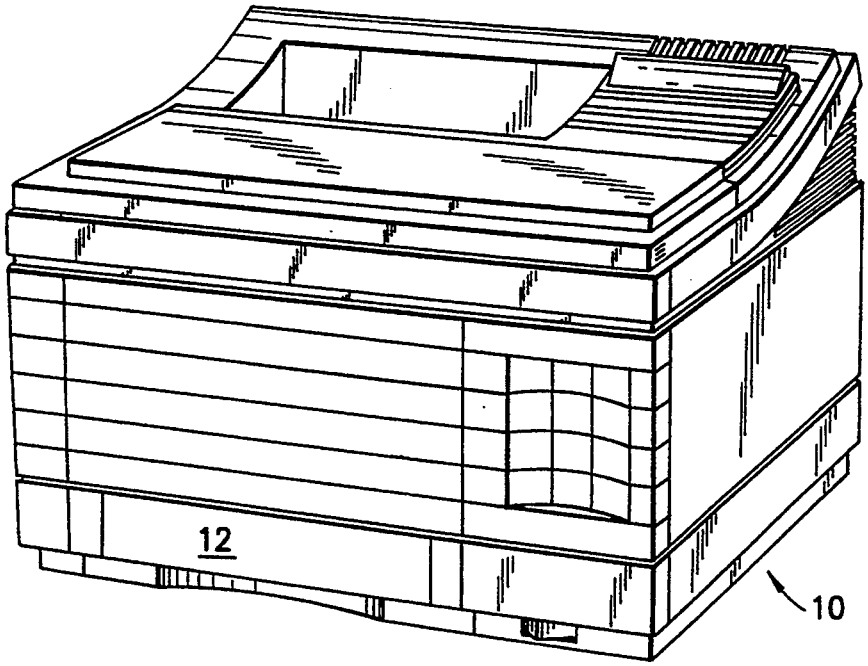
FIG. 1 is a perspective view of a laser printer which includes a removable, paper tray that is front-loadable into the printer.
Figure 2:
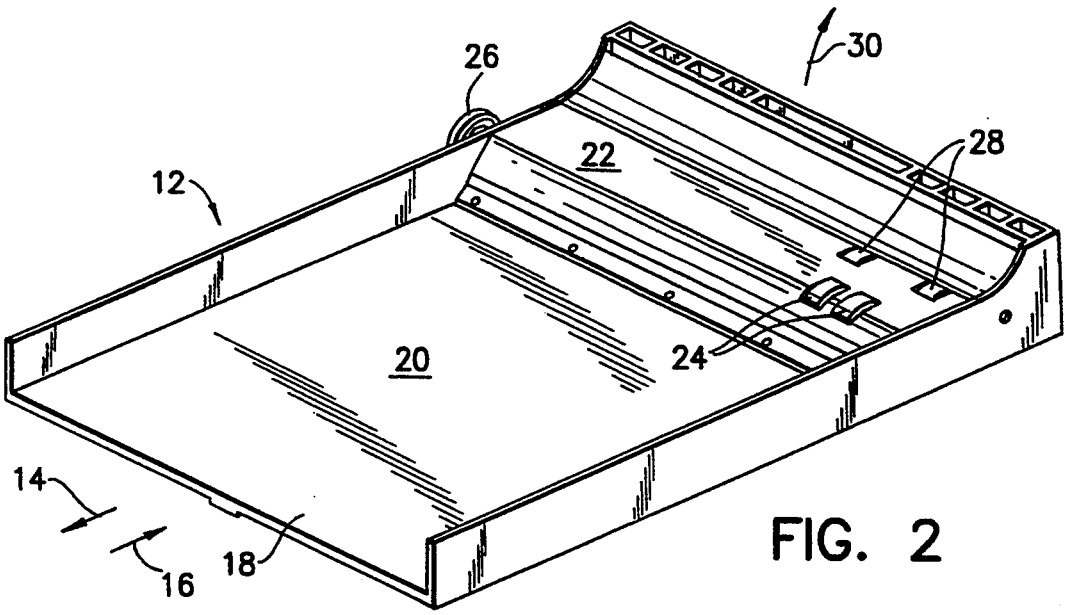
FIG. 2 is a perspective view of the paper tray, after its removal from the laser printer of FIG. 1.

In FIG. 1, a laser printer 10 includes a front-loadable paper tray 12 which may be inserted into and/or extracted from printer 10 by hand. In FIG. 2, paper tray 12 has been removed from laser-printer 10 and rotated approximately 180 degrees so as to expose inner portions thereof. Paper tray 12 is inserted into laser-printer 10 in the direction indicated by arrow 14 and is extracted therefrom in the direction indicated by arrow 16. A stack of paper sheets is held in recess 18, with the stack resting upon a floor 20.

A cover 22 hides portions of the paper pick/feed mechanism which are incorporated into paper tray 12. A pair of lower separator rollers 24 extend through openings in cover 22 and are connected via a shaft (not shown in FIG. 2) to an input power gear 26. A pair of pressure rollers 28 extend through openings in cover 22, are resiliently mounted and are free-wheeling. Cover 22 is concavely shaped so as to direct a sheet of paper that is picked from recess 18 and to direct it upwardly in the direction indicated by arrow 30.

Figure 3:
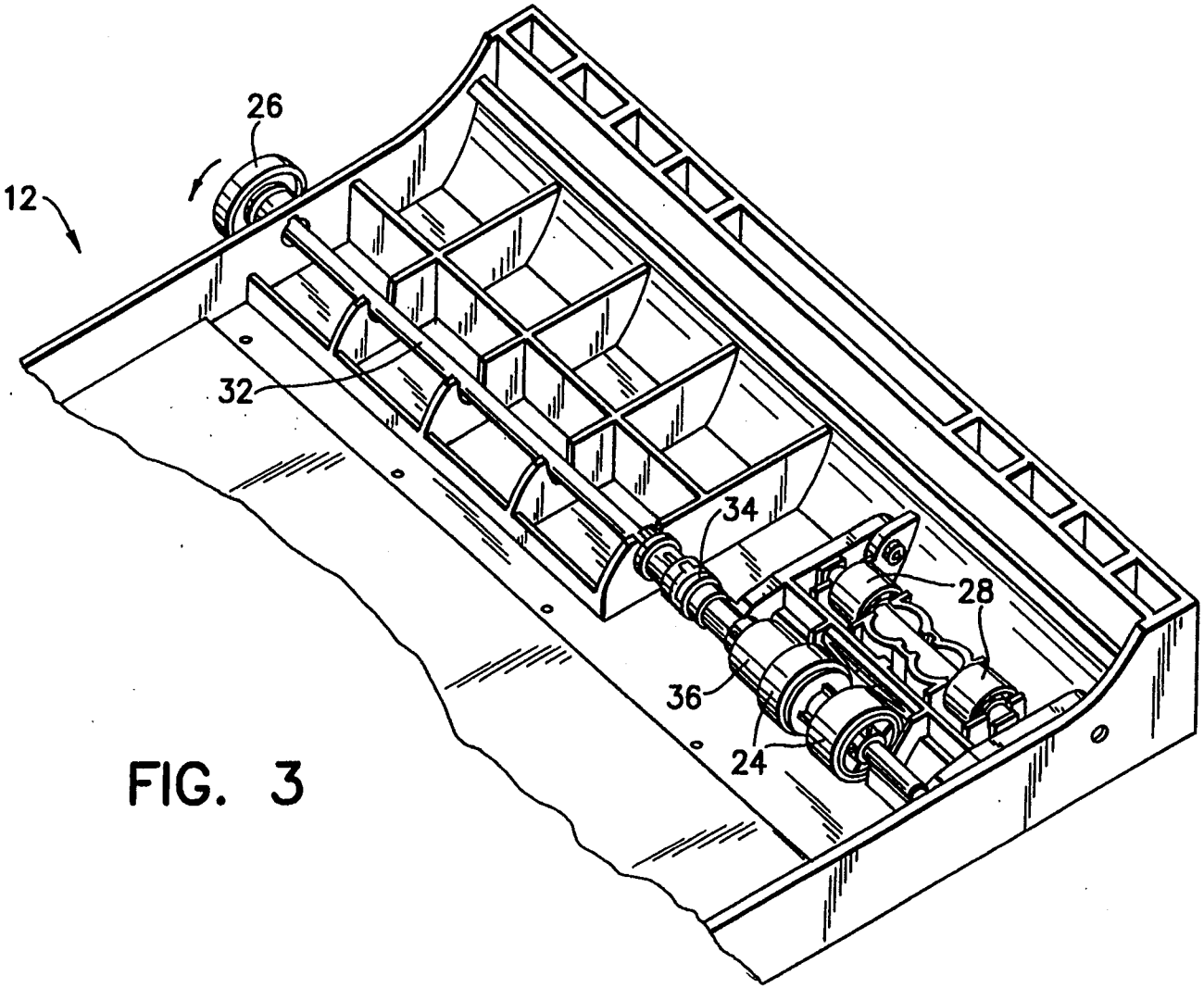
FIG. 3 is a partial perspective view of the paper tray of FIG. 2, with a cover portion removed.

In FIG. 3, cover 22 has been removed so as to expose the portions of the paper pick feed mechanism incorporated into paper tray 12. Power input to paper tray 12 occurs as a result of engagement of input power gear 26 with a mating drive gear within laser printer 10 (to be described below). Input power gear 26 is coupled to a tray drive shaft 32 which is, in turn, connected to a flexible coupler 34. A pair of lower separator rollers 24 are coupled to a friction/slip clutch 36 which is, in turn, connected to flexible coupler 34.

As will be hereafter understood, input power gear 26 is rotated in a counter-clockwise (CCW) direction, thereby causing lower separation rollers 24 also to rotate in a CCW direction. This action performs a sheet-separation function and prevents the feeding of plural sheets into laser-printer 10. Friction/slip clutch 36 prevents lower separation rollers 24 from exerting too great a friction force on mating rollers when either a single sheet is fed or when no sheets are present in tray 12.

Pressure rollers 28 are spring biased upwardly and extend through cover 22 so as to exert a pressure function on a mating drive roller that is incorporated into the portion of the sheet feed mechanism housed within laser/printer 10.

Figure 4:
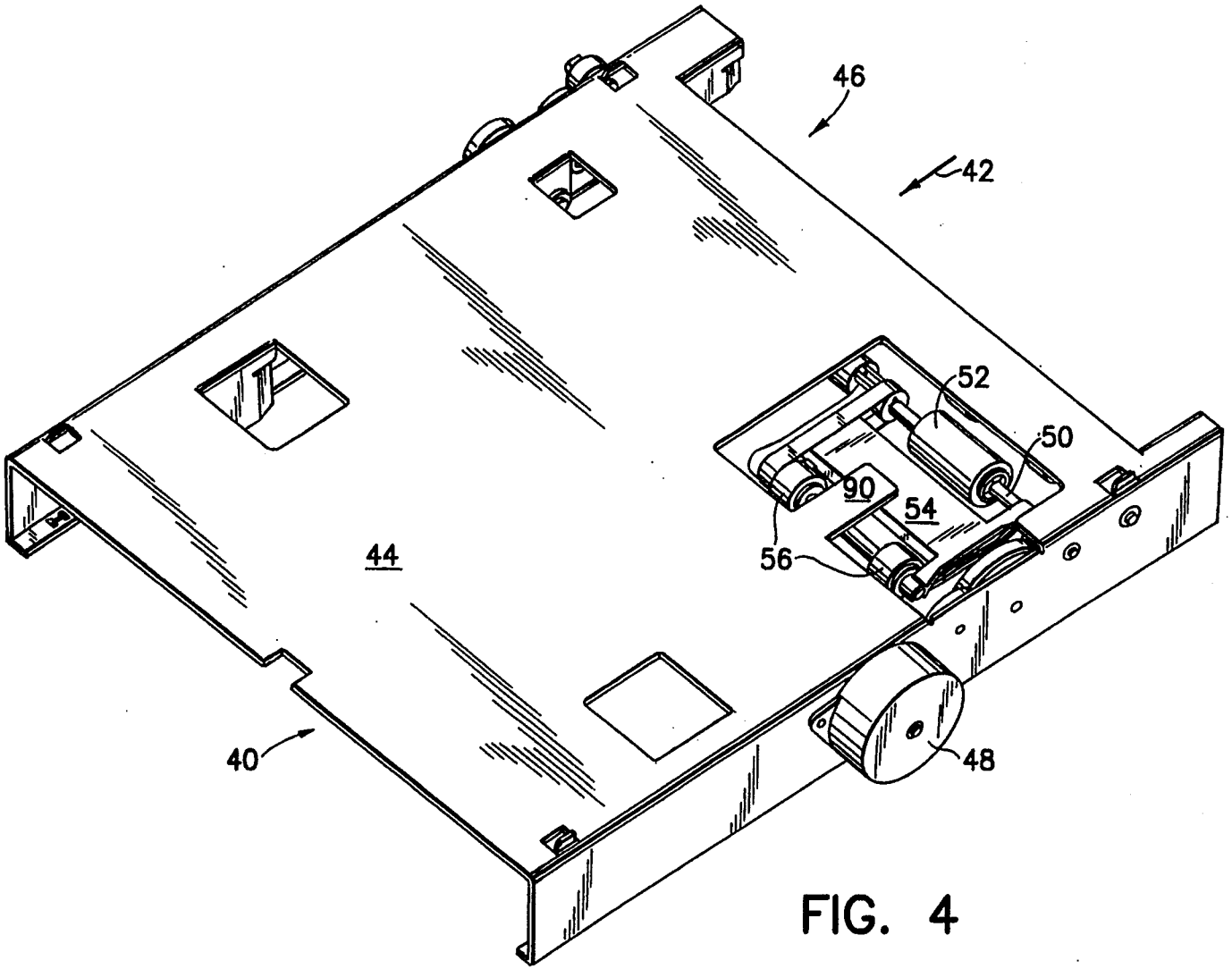
FIG. 4 is a perspective view of a tray-receiving frame that is incorporated into the laser printer of FIG. 1.

When paper tray 12 is inserted into laser/printer 10, it engages a tray-receiving frame 40 shown in FIG. 4. Paper tray 12 is inserted into tray-receiving receiving frame 40 in the direction shown by arrow 42. When paper tray 12 is in position within tray-receiving frame 40, recess 20 resides beneath ceiling portion 44 of tray receiving frame 40. Ceiling portion 44 includes a cut-out area 46 that enables paper sheets to be fed from a stack in recess 20 in the direction indicated by arrow 30 in FIG. 2. A drive motor 48 is mounted on a side of tray-receiving frame 40 and, via a gear train, engages a separator shaft 50, an upper separator roll 52, a pick arm assembly 54 and a pair of pick rollers 56. Remaining portions of the pick/feed mechanism are largely hidden in FIG. 4, but are fully exposed in FIG. 5 wherein tray receiving frame 40 has been removed.

Figures 5, 6:
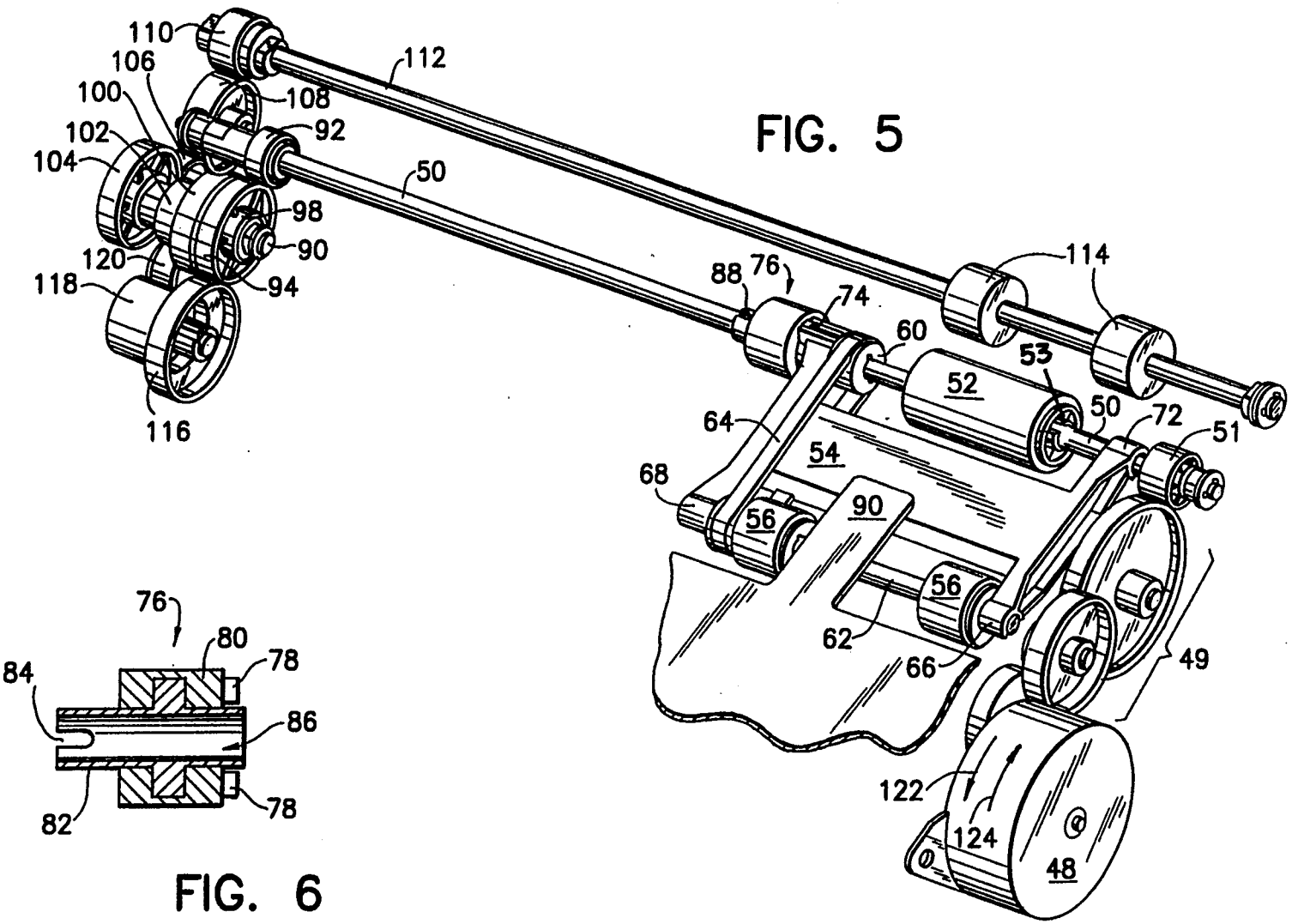
FIG. 5 is a perspective view of the paper feed mechanism that forms a portion of the tray-receiving frame.
FIG. 6 is a sectional view of a friction/slip clutch incorporated into the mechanism of FIG. 5.

Turning to FIG. 5, details of the pick and paper feed mechanism contained within tray-receiving frame 40 will be described, as will the mechanism's interaction with the portions of the pick/feed mechanism included in paper tray 12. Drive motor 48 is bidirectional and couples its rotary driving force through a gear train 49 to separator shaft drive gear 51 which is caused to rotate in the same direction as motor 48.

Separator shaft drive gear 51 is directly coupled to separator shaft 50 upon which upper separator roller 52 is mounted via a one-way clutch 53. A pulley 60 is rigidly attached to separator shaft 50 and enables the rotary motion of shaft 50 to be transmitted to a pick roller drive shaft 62 via a belt 64. Pick rollers 56 are rigidly mounted on pick roller drive shaft 62 and are rotatable through the drive action exerted by drive belt 64 on a pulley mounted adjacent one of pick rollers 56. Pick roller drive shaft 62 is mounted for rotation in a pair of journals 66 and 68 that form a portion of a pick arm assembly 54. Pick arm assembly 54 performs a function of supporting pick rollers 56 and enabling their selective rotation about separator shaft 50. Pick arm assembly 54 is an H-shaped molded unit which includes a further journal 72 that is rotatably coupled onto separator shaft 50. At the other extremity of pick arm assembly 54 is a journal 74 which is mounted on separator shaft 50, and is rigidly coupled to one portion of a friction/slip clutch 76.

A sectional view of friction/slip clutch 76 is shown in FIG. 6. Slots in journal 74 engage coupling pins 78 which extend from first clutch member 80. A second clutch member 82 is positioned interiorly to first clutch member 80 and is rotatable with respect thereto. Second clutch member 82 includes a slot 84. Separator shaft 50 (FIG. 5) extends through cylindrical opening 86 within friction slip clutch 76 and, via a pin 88, engages slot 84 and couples its rotary motion to second clutch member 82. As will be understood from the description below, when separator shaft 50 rotates CCW, that motion is transmitted to second clutch member 82 via the interaction of pin 88 and slot 84. The rotation of second clutch member 82 causes rotation of first clutch member 80 in the CCW direction. Pins 78 engage pick arm assembly 54 and cause a CCW rotation thereof, thereby causing pick arm assembly 54 and pick rollers 56 to rotate in a CCW direction and to engage a paper sheet to be fed.

When pick rollers 56 are to be brought out of engagement with a paper stack, separator shaft 50 is rotated in a clockwise direction (CW) thereby causing pick arm assembly 54 and pick rollers 56 to rotate in a CCW direction until pick roller drive shaft 62 encounters stop 90 that forms a portion of tray receiving frame 40.

Separator shaft 50 (at the opposite end from separator shaft drive gear 51) is rigidly coupled to a second separator shaft drive gear 92. A follower gear 94 engages second separator shaft gear 92 and is, in turn, coupled to axle 96 via a one way clutch 98. One way clutch 98 couples follower gear 94 to axle 96 only when driven in a CCW direction by second separator shaft gear 92. When follower gear 92 is rotated in a CW direction, no rotational motion is imparted to axle 96.

A tray drive gear 100 is rigidly mounted to axle 96 and is positioned to engage input power gear 26 in paper tray 12, when paper tray 12 is positioned in laser-printer 10. A further drive gear 102 is coupled via a one-way clutch (not shown) to axle 96, however, that one-way clutch is operative in an opposite direction to that of one-way clutch 98. Axle 96 is rigidly coupled to a drive gear 104 which, via idler gears 106 and 108, causes a drive action to be imparted, via gear 110, to feed roller drive shaft 112. A pair of upper feed rollers 114 are rigidly mounted to feed roller drive shaft 112.

Follower gear 94, in addition to being coupled to axle 96 via one way clutch 98, further engages a gear 116 which, through the action of gears 118 and 120, imparts a drive action to drive gear 102 when one way clutch 98 has disengaged follower gear 94 from axle 96.

Thus, when second separator shaft gear 92 rotates in a CCW direction, follower gear 94 is driven in a CW direction, causing one way clutch 98 to impart rotary CW motion to axle 96. The motion causes tray drive gear 100 to rotate in a CW direction and to impart a CCW direction to input power gear 26 in paper tray 12. As a result, lower separation rollers 24 rotate in a CCW direction (which is opposite to the direction taken by upper separation roller 52).

CW rotation of follower gear 94 (via gears 116, 118 and 120) imparts a CCW rotation to drive gear 102.

However, because drive gear 102 is coupled to axle 96 by a one way clutch which operates in opposition to one way clutch 98, drive gear 102 free wheels and imparts no drive action to axle 96.

When second separator shaft gear 92 is rotated CW, follower gear 94 rotates CCW and imparts no drive action to axle 96 through one way clutch 98. However, the CCW rotation of follower gear 94 causes a CW rotation of gears 116 and 118 and, via idler gear 120, causes a CW rotation of drive gear 102. The CW rotation of drive gear 102 is coupled to axle 96 via the one way clutch present therein and causes tray drive gear 100 and drive gear 104 to rotate in a CW direction. the CW rotation of drive gear 104 imparts, through idler gears 106 and 108 and feed roller drive gear 110, a continued CCW rotation of feed roller shaft 12.

The CW rotation of tray drive gear 100 causes a CCW rotation of input power gear 26, tray drive shaft 32 and separation rollers 24. Irrespective of the direction of rotation of separator shaft 50, feed roller shaft 12 is always caused to rotate in a CCW direction as is tray drive shaft 32 in paper tray 12. Thus, when upper separator roller 52 rotates in a CCW direction, lower separator roller also rotates in a CCW direction causing a paper separation action to occur. It will be recalled that upper separator roller 52 is mounted on separator shaft 50 via a one way clutch 53 which only imparts rotative motion between shaft 50 and upper separator roller 52 when shaft 50 rotates in a CCW direction. Thus, when separator shaft 50 rotates in a CW direction, separator roller 52 is adapted to free wheel.

The operation of the paper pick mechanism will now be described in conjunction with the showings in FIG. 3, 5, 7 and 8.

Figure 7:
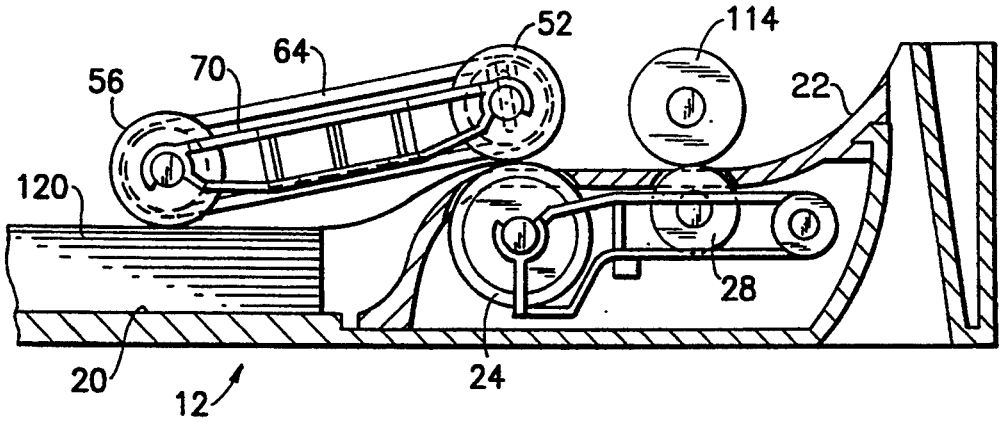
FIG. 7 is a side schematic view of the paper pick and feed mechanism during a pick operation.
Figure 8:
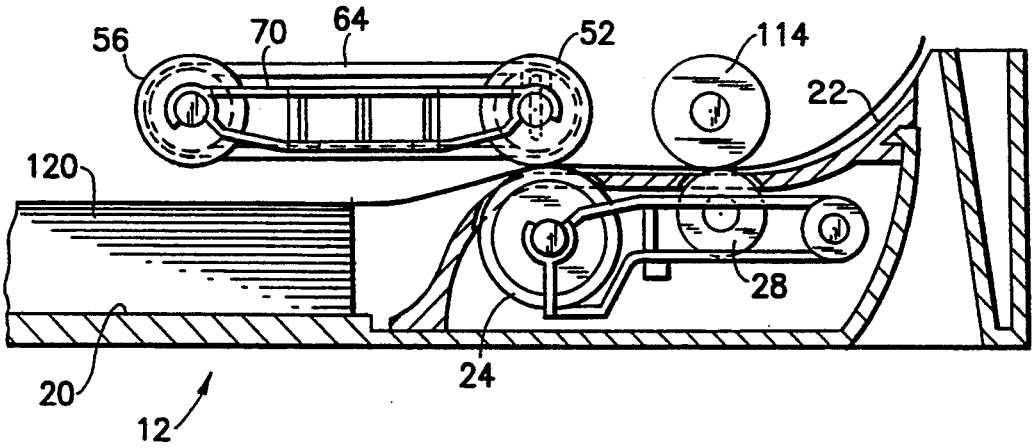
FIG. 8 is a side schematic view of the paper pick and feed mechanism during a feed operation.

Referring first to FIG. 7, assume that a stack of paper sheets 120 is present on floor 20 of paper tray 12. Note that paper tray 12 is inserted into laser printer 10 in the leftward direction (as shown in FIG. 7) beneath pick arm assembly 54. When paper tray 12 is at the limit of its leftward travel, lower separation rollers 24 are in contact with upper separation roller 52. A resilient mounting of lower separation rollers 24 enables good frictional contact between the upper and lower separation rollers. (No vertical movement of stack 120 is required). Also, tray drive gear 100 engages input power gear 26 in tray 12.

A paper pick action commences by a microprocessor within laser-printer 10 causing drive motor 48 (FIG. 5) to rotate in CCW direction 122. The CCW rotary motion is transferred to separator shaft drive gear 51 by gear train 49 and causes its rotation in a CCW direction. As a result, separator shaft 50, upper separator roller 52, pulley 60, and second separator shaft gear 92 are all rotated in a CCW direction. The rotation of pulley 60 causes pick rollers 56 to rotate in a CCW direction so as to enable a paper pick of a top sheet of paper from stack 120.

Before the paper pick action can commence, pick rollers 56 must be brought into contact with an uppermost sheet on stack 120. That action is caused by friction/slip clutch 76 imparting a CCW force to slotted journal 74, thus causing pick arm assembly 54 to rotate in a CCW direction and to bring pick rollers 56 into contact with paper stack 120. Once pick rollers 56 contact an uppermost sheet, pick action commences and causes a sheet to move in a rightward direction. Due to the slipping action of friction/slip clutch 76, a continuous force is exerted on pick arm assembly 54 and maintains pick rollers 56 in contact with paper stack 120.

The CCW rotation of second separator shaft gear 92 causes follower gear 94 to rotate in a CW direction and, via one way clutch 98 and axle 96, causes a CW rotation of tray drive gear 100. That rotation imparts a CCW rotation to input power gear 26 (FIG. 3), causing tray drive shaft 32 and lower separation rollers 24 to also rotate in a CCW direction. Thus, during a pick operation, it can be seen that when upper separator roller 52 rotates in a CCW direction, so also do lower separation rollers 24. The counter directional movement of lower separation rollers 24 prevents a double page feed. Furthermore, should there be no paper between the separator rollers or only a single sheet, friction/slip clutch 36 is activated thereby preventing a potentially damaging frictional force from being exerted on the mechanism.

Turning back to FIG. 5, the CW rotation of axle 96 imparts no motion to drive gear 102 as it is mounted on axle 96 via a one way clutch whose direction of clutch operation is opposite to that of one way clutch 98. Thus, drive gear 102 is only caused to rotate when axle 96 rotates in a CCW direction.

The CW rotation of axle 96 is imparted to drive gear 104 which, through idler gears 106 and 108, causes gear 110 and feed roller shaft 112 to rotate in a CCW direction. As a result, upper feed rollers 114 are also caused to rotate in a CCW direction. Through the action of the gear train connected to second separator shaft gear 92, feed roller shaft is caused to rotate in a CCW direction. Upper feed rollers 114 bear against pressure rollers 28 (resiliently mounted in paper tray 12).

Drive motor 122 is driven in CCW direction 122 for a long enough time to allow pick rollers 56 to drive a top-most sheet from paper stack 120 to and through separator rollers 24, and 52 and into engagement with upper feed rollers 114. Upon such engagement, the rotation of drive motor 48 is changed to a CW rotation 124. The CW direction of drive motor 124 causes separator shaft drive gear 51 to rotate in a CW direction, thereby reversing the direction of rotation of separator shaft 50, pulley 60 and second separator shaft gear 92. As will be remembered, upper separator roller 52 is mounted to separator shaft 50 via one way clutch 53. Thus, during the feed operation when upper feed rollers 114 rotate in a CCW direction, upper separator roller 52 is enabled to free wheel in the CCW direction and provides no actual driving force to the picked paper sheet.

The CW rotation of separator shaft 50 is imparted through friction/slip clutch 76 to pick arm assembly 54, thereby causing it to rotate in a CW direction (see FIG. 8) until pick roller drive shaft 62 contacts stop 90. The continuing clutching action of friction/slip clutch 76 maintains pick arm assembly 54 in its elevated position for the duration of the CW rotation of separator shaft 50.

The CW rotation of second separator shaft gear 92 imparts a CCW rotation to follower gear 94, but, due to the action of one way clutch 98, imparts no motion to axle 96. However, idler gears 116 and 118 are rotated in the CW direction, causing follower gear 120 to rotate in a CCW direction and drive gear 102 to rotate in a CW direction. As above indicated, drive gear 102 is mounted via a one way clutch onto axle 96, which is activated during a CW rotation of drive gear 102. Axle 96 is thus rotated in a CW direction, thereby causing, through the action of drive gear 104, idler gears 106, 108 and drive gear 110, a rotation of feed roller shaft 112 in a CCW direction. Upper feed rollers 114 also rotate in the CCW direction.

To recapitulate, a CCW rotation of second separator shaft gear 92 causes gear 110 to be driven in the CCW direction through the path of follower gear 94, one way clutch 98, axle 96, drive gear 104 and idler gears 106, and 108. By contrast, when second separator shaft gear 92 rotates in a CW direction, gear 110 is driven CCW through the path: follower gear 94, gears 116, 118, idler gear 120, drive gear 102, axle 96, drive gear 104, and idler gears 106, 108. It is to be noted that during the CW rotation of gear 94, follower gears 116 and 118 are caused to rotate in a CW direction and idler gear 120 in a CCW direction. However, due to the clutch action associated with drive gear 102, no motion is imparted to axle 96 by that action.

The CCW rotation of upper feed rollers 114, in conjunction with pressure rollers 28 in tray 12, causes an uppermost sheet of stack 120 to be fed in a generally upward manner, as directed by curved cover 22. Once the uppermost sheet has passed through upper feed rollers 114, the mechanism is ready to recycle and feed a next sheet.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An apparatus for producing marks on a media sheet, said apparatus comprising:

a tray receptacle in communication with an opening in said apparatus and having a first end for receiving a media tray inserted through said opening;

pick roller means;

separator shaft means, including first separator roll means mounted thereon;

arm means connecting said pick roller means to said separator shaft means and enabling a pick action to be imparted to said pick roller means by rotation of said separator shaft means in a first direction;

feed roll means coupled to said separator shaft means;

a removable media tray positioned in said tray receptacle for holding a stack of media sheets, second separator roll means positioned to engage said first separator roll means when said media tray is positioned in said tray receptacle and separable coupling means for imparting rotative motion to said second separator roll means from said separator shaft means; and control means for (i) causing a rotation of said separator shaft means and said first separator roll means in said first direction to enable said pick action of said pick roller means and to simultaneously rotate said second separator roll means to enable a media sheet separation action, and (ii) for rotating said separator shaft means in a second direction to disable said pick action and to rotate said feed roll means to accomplish a feed of a media sheet from sheets positioned in said media tray.

2. The apparatus as recited in claim 1, wherein said media tray includes a fixed planar surface for holding said stack of media sheets.

3. The apparatus as recited in claim 2, wherein said arm means extends generally towards a first inserted end of said media tray and said pick roller means is positioned over said fixed planar surface and any media sheets positioned thereon.

4. The apparatus as recited in claim 3, wherein operation of said pick roller means and feed roll means by said control means causes a media sheet to be fed from a stack of media sheets on said fixed planar surface, in a direction towards said opening, said media tray including a structure that redirects a fed media sheet into a mark-producing region of said apparatus.

5. The apparatus as recited in claim 4, wherein said separator shaft means comprises:

a separator shaft;

a tray drive gear for engaging said separable coupling means on said media tray when said media tray is present in said tray receptacle;

first gear means for coupling said separator shaft to said feed roll means and said tray drive gear when said separator shaft is caused to rotate in said first direction by said control means, said coupling causing rotation of said feed roll means and tray drive gear in an initial rotative direction; and second gear means for coupling said separator shaft to said feed roll means and said tray drive gear when said separator shaft is caused to rotate in said second direction by said control means, said coupling causing rotation of said feed roll means and tray drive gear in said initial rotative direction.

6. The apparatus as recited in claim 5, wherein said separator roll means is mounted on said separator shaft via a clutch mechanism that enables said separator shaft to power said separator roll means when said separator shaft rotates in said first direction, and disables driving action to said separator roll means when said separator shaft rotates in said second direction.

7. The apparatus as recited in claim 3, wherein said arm means is connected to said separator shaft means by friction clutch means, said friction clutch means responsive to rotation of said separator shaft means in said first direction to cause said pick roller means to bear against a stack of media sheets in said media tray, and further responsive to rotation of said separator shaft means in said second direction to rotate said pick roller means out of engagement with said stack of media sheets and into engagement with a stop.

8. The apparatus as recited in claim 7, wherein said pick roller means is coupled to said separator shaft means by a direct drive means.

9. A media tray for use in an apparatus for producing marks on a media sheet, said apparatus including an opening leading to a tray receptacle within said apparatus, said tray receptacle having a first end juxtaposed to said opening for receiving said media tray, said media tray comprising:

a rectangular shaped receptacle for holding a stack of media sheets on a fixed surface;

a media sheet separator roll positioned adjacent said rectangular shaped receptacle in a media feed direction and adapted to engage a mating separator roll in said apparatus when said media tray is positioned in said tray receptacle; and separable coupling means for imparting rotative motion to said media sheet separator roll and operative to interconnect to a drive means in said apparatus when said media tray is positioned in said tray receptacle.

10. The media tray as recited in claim 9, wherein said media feed direction is towards said first end of said tray receptacle, and said media sheet separator roll is positioned intermediate said rectangular shaped receptacle and an end of said media tray that is positioned at said opening when said media tray is present in said tray receptacle, said media tray further including a surface for deflecting a media sheet upward from said media tray after said media sheet passes over said separator roll.

* * * * *